United States Patent [19]

Ganz

[11] 3,965,645

[45] June 29, 1976

[54] PACKAGE TIGHTENER AND METHOD

[76] Inventor: Robert H. Ganz, 8 Ridgecrest Road, Saddle River, N.J. 07458

[22] Filed: Aug. 26, 1974

[21] Appl. No.: 500,489

[52] U.S. Cl. ..... 53/32; 53/229

[51] Int. Cl.[2] ..... B65B 11/48

[58] Field of Search ..... 53/32, 228, 230, 232, 53/182 R, 30 R, 229, 231

[56] References Cited

UNITED STATES PATENTS

| | | | |
|---|---|---|---|
| 2,744,371 | 5/1956 | Hoppe | 53/230 |
| 3,340,675 | 9/1967 | Minalga | 53/228 |
| 3,470,814 | 10/1969 | Tschappu | 53/198 X |
| 3,596,434 | 8/1971 | Zelnick | 53/182 |
| 3,660,961 | 5/1972 | Ganz | 53/32 X |
| 3,683,586 | 8/1972 | Duckhinsky | 53/228 |
| 3,914,893 | 12/1959 | Berst | 53/184 |

*Primary Examiner*—Travis S. McGehee
*Assistant Examiner*—John Sipos
*Attorney, Agent, or Firm*—Diller, Brown, Ramik & Wight

[57] ABSTRACT

This disclosure relates to an improvement in a machine for automatically wrapping articles with a sheet of shrinkable plastic film to form individual packages. It is proposed to provide the machine with a support roller over which partially formed packages pass with the support roller having associated therewith a brake for retarding the rotation of the roller in timed relation to the passage of partially formed packages with the roller, when braked, frictionally engaging a leading bottom panel of the sheet material so as to tighten the sheet material around the article being packaged. The brake is automatically released as the rear half of the package engages the roller so as to permit the freedom of movement of the rear half of the package thereover.

6 Claims, 3 Drawing Figures

FIG.1
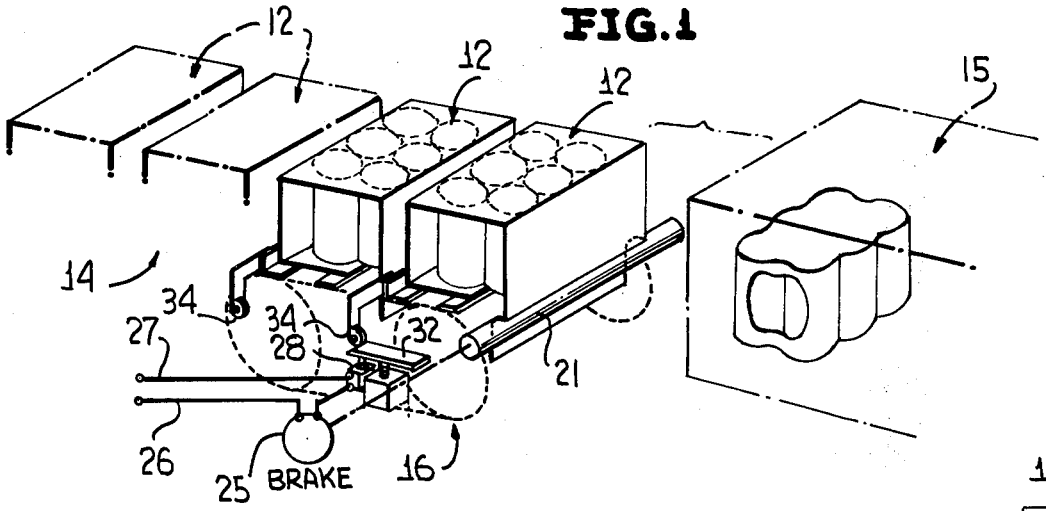
FIG.2
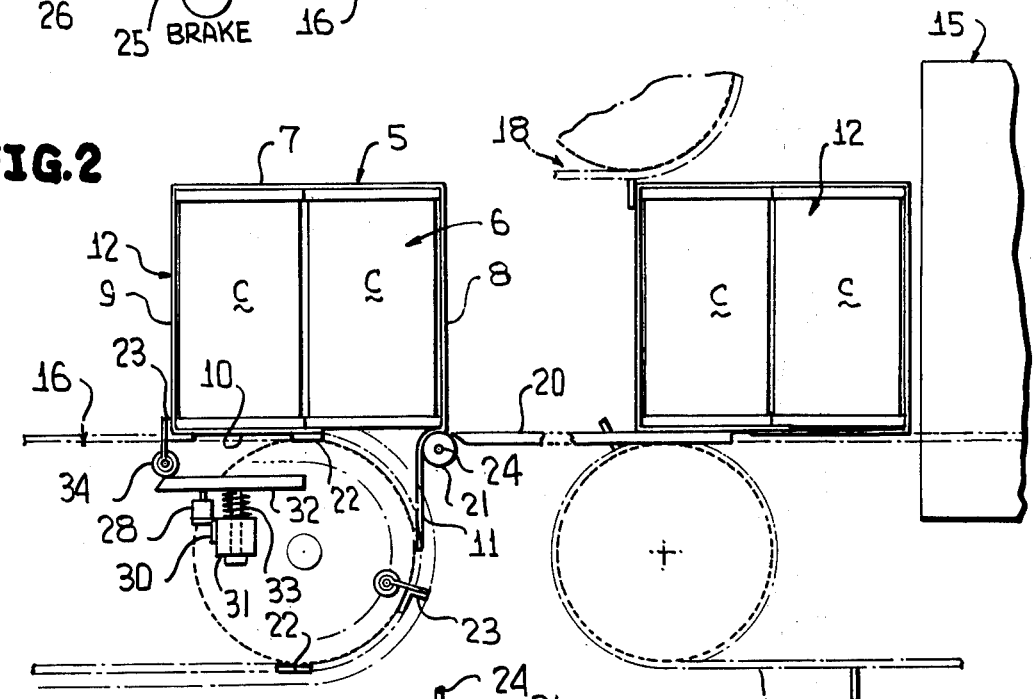
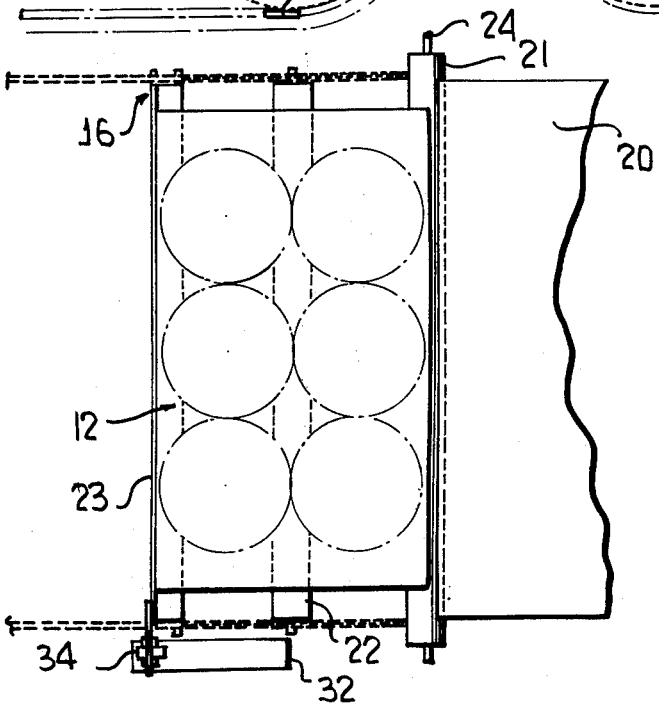
FIG.3

PACKAGE TIGHTENER AND METHOD

This invention relates in general to new and useful improvements in the packaging of clusters of articles, such as beverage containers, by applying to each cluster a wrapping in the form of shrinkable plastic film or sheet, and more particularly to a support roll arrangement which is operable to automatically tighen the partially formed package as it passes over the support roll.

This invention particularly relates to an improvement in the packaging machine and method disclosed in my prior U.S. Pat. No. 3,660,961, granted May 9, 1972.

In accordance with my prior U.S. Pat. No. 3,660,961, a sheet of shrinkable plastic film is applied over the top of an article to be packaged, which is disclosed as being a cluster of containers arranged in two rows, with the sheet material passing vertically downwardly in front of and behind the cluster of containers and terminating in front and rear bottom panels. As the partially formed package progresses along the machine, the rear bottom panel is folded forwardly beneath the article being packaged and thereafter it is necessary to rearwardly fold the front bottom panel so that the rear edge portion thereof is in overlapping relation with respect to the forward edge portion of the rear bottom panel.

This invention relates to means for folding the front bottom panel rearwardly beneath the article being packaged with the front bottom panel being tensioned so as to tightly draw the sheet material around the article being packaged and in the case of a cluster of containers, to tightly pull the containers together.

In accordance with this invention, the panel folding device and package tightener is in the form of a simple support roller which normally is free to rotate as a partially formed package passes thereover, but which has associated therewith a brake which retards rotation thereof in timed relation to the passage of a package thereover so as to frictionally engage the front bottom panel.

With the above and other objects in view that will hereinafter appear, the nature of the invention will be more clearly understood by reference to the following detailed description, the appended claims and the several views illustrated in the accompanying drawings:

IN THE DRAWINGS:

FIG. 1 is a schematic perspective view showing the environment and operation of the invention.

FIG. 2 is an enlarged schematic side elevational view showing more specifically the details of the invention.

FIG. 3 is a fragmentary plan view of a portion of the machine shown in FIG. 2.

As is specifically disclosed in my prior U.S. Pat. No. 3,660,961, containers C are arranged in clusters with each cluster including a front row and a rear row of containers. In a manner which in no way forms a part of this invention, but which is fully disclosed in my U.S. Pat. No. 3,660,961, a sheet of shrinkable plastic film 5 is applied to a cluster, generally identified by the numeral 6, and is severed from the remainder of the sheet material so as to define a top panel 7, which overlies the containers, a front side panel 8, a rear side panel 9, a forwardly extending rear bottom panel 10 and a depending front bottom panel 11.

As each partially formed package, generally identified by the numeral 12, approaches the exit end of the packaging machine, generally identified by the numeral 14, and prior to the entry thereof into a shrink tunnel, generally identified by the numeral 15, it is suitably supported by a conveyor, generally identified by the numeral 16. The conveyor 16 both supports the partially formed package 12 and facilitates the movement thereof. It is to be understood that the conveyor 16 corresponds to the pair of endless chain systems 140 specifically disclosed in my U.S. Pat. No. 3,660,961 and is only schematically illustrated herein so that a full understanding of the invention may be had. Further, it is to be understood that the conveyor 16 will normally be supplemented by a further conveyor (not shown) which will correspond to the conveyor system of which the chains 131 of my U.S. Pat. No. 3,6660,961 form a part.

With particular reference to FIG. 2, it is to be understood that as the wrapped clusters 6 pass from the packaging machine 14 into the shrink tunnel 15, they are transferred to a conveyor system, generally identified by the numeral 17, which may correspond to the conveyor system 230 of my U.S. Pat. No. 3,660,961. Transfer of the partially formed packages 12 from the packaging machine 14 to the conveyor system 17 is aided by means of an overhead conveyor system 18 which may correspond with conveyor chain systems 231 of my U.S. Pat. No. 3,660,961. The partially formed packages 12 are transferred from the packaging machine 14 to the conveyor 17 by means of a deadplate 20 although other types of transfer means may be utilized.

At the exit end of the packaging machine 14, there is provided a support roller 21 which is positioned between the conveyor 16 and the deadplate 20, as is clearly shown in FIG. 2. The position of the roller 21 is such that all partially formed packages pass over the roller 21 and are supported thereby.

At this time it is pointed out that for illustrative purposes only, the conveyor 16 is illustrated as including sets of package supports which include a front support 22 and a rear support 23, the rear support 23 being in the form of a combination support and pusher. The arrangement of the supports 22 and 23 is such that a cluster 6 of containers C may be suitably supported during the movement thereof along the packaging machine 14.

The roll 21 is supported for rotation about a fixed axis and is illustrated as including a supporting shaft 24. Associated with the roll 21 is an electric brake 25 of a conventional type which is connected by wires 26 and 27 to a convenient source of electrical energy through a switch 28. The brake 25 is operable to retard the rotation of the roll 21 with the degree of retardation, including the possible stoppage of rotation of the roll 21 being controllable.

Referring more specifically to FIG. 2, it will be seen that the switch has been diagrammatically illustrated as being carried by a bracket 30 mounted on a support 31 which, in turn, supports for vertical movement a switch actuator 32 of a predetermined length. The switch actuator 32 is urged to a switch off position by means of a spring 33.

Carried by each rear support 23 is a further switch actuator 34 which cooperates with the switch actuator 32 so as to depress the same and move the switch 28 to an on position and to retain the switch 28 in the on position for a predetermined length of time.

It is to be readily understood that means other than the illustrated means for actuating the switch 28 may be provided.

OPERATION

It is to be understood that the roll 21 is mounted for freedom of rotation. As a cluster 6 of containers C approach the roll 21, the switch 28 is moved to its on position energizing the brake 25 and retarding the rotation of the roller 21. Thus, as a partially formed package 12 passes over the roll 21, the front bottom panel 11 is frictionally engaged with the roll 21 and a drag is placed thereon by the roll 21. Thus, the front bottom panel 11 is simultaneously folded upwardly beneath the front row of containers C and is tensioned so as to tightly pull the sheet material 5 around the containers C. Finally, the drag placed on the front bottom panel 11 is sufficient to tightly pull together the containers C of the cluster 6 so as to form a very tight package.

The brake 25 remains energized until the leading portions of the trailing row of containers C are ready to come into supported relation with respect to the roll 21. At this time, the brake 25 is de-energized and the roll 21 is again free to rotate so that the partially formed package is free to pass over the roll 21 with a minimum of resistance.

It will be readily apparent from the foregoing that by controlling the rotation of the roll 21, the roll 21 can properly function as a support for partially formed packages 12 passing thereover and at the same time may apply tension on the front bottom panel 11 only so as to effectively tighten the package while in no way intending to open the package as the front row of containers C pass thereoff of and the rear row of containers C move thereonto.

After the front bottom panel 11 has been folded into place and the package tightened, the partially formed package 12 is then moved into the shrink tunnel 15 and the package completed in the manner disclosed in my U.S. Pat. No. 3,660,961.

At this time it is particularly pointed out that the manner in which the roll 21 is supported, the construction of the brake 25 and the manner in which the brake 25 is actuated in timed relation to the movement of a partially formed package over the roll 21 in no way form a specific part of my invention and may be modified in any desired manner to meet the requirements of the specific wrapping machine. Further, it is to be understood that the article being wrapped is in no way to be limited to a cluster of containers although this is the principal environment of my invention.

It is also to be understood that the surface of the roll 21 may be varied as desired to provide for a required frictional contact between the roll 21 and the front bottom panel 11.

Although only a single embodiment of my invention has been specifically illustrated and described herein, it is to be understood that minor variations may be made therein without departing from the spirit and scope of the invention, as defined by the appended claims.

I claim:

1. In a container wrapping machine of the type wherein sheet material is applied over a moving article being packaged with the sheet material extending vertically down front and back sides of the article and terminating in a forwardly extending rear bottom panel and a rearwardly extending front bottom panel, said machine including a support roll, means mounting said support roll for rotation about an axis and in the path of movement of partially formed packages, brake means connected to said roll for selectively retarding rotation of said roll, and control means for actuating said brake means in timed relation to movement of packages over said roll to retard rotation of said roll during movement of a front part of a package thereover to tension a front panel rearwardly and tighten a package being formed and to release said roll during movement of a rear part of a package thereover to permit freedom of movement of a rear part of a package.

2. The machine of claim 1 wherein said machine is of the type having means for providing each partially formed package with a front bottom panel which is in depending relation approaching said roll, and said roll also constitutes means for folding each front panel rearwardly beneath an article being packaged.

3. The machine of claim 2 wherein said machine is of the type having means for packaging containers arranged in front and rear rows, and said control means are operable to release said brake means as a rear row of containers begins to move onto said roll.

4. The machine of claim 1 wherein said machine is of the type having means for packaging containers arranged in front and rear rows, and said control means are operable to release said brake means as a rear row of containers begins to move onto said roll.

5. A method of tightening a moving partially formed package of the type including an article having sheet material overlaying the same and extending vertically down front and back sides of the article and terminating in a forwardly extending rear bottom panel and a rearwardly extending front bottom panel, said method comprising the steps of providing a predetermined path of movement for said partially formed package, providing a support roll extending across said predetermined path, moving said partially formed package along said predetermined path and over said support roll in contact therewith, retarding rotation of said support roll to frictionally engage the front bottom panel as the partially formed package moves forward past said support roll and thereby tensioning the front bottom panel and tightening the package, and thereafter permitting the support roll to rotate thus permitting the rear bottom panel to freely pass over the support roll.

6. A method of tightening in accordance with claim 5 wherein the article is two rows of containers and the frictional engagement is maintained only under a front one of the two rows of containers.

* * * * *